US005922664A

United States Patent [19]

Cao et al.

[11] Patent Number: 5,922,664

[45] Date of Patent: Jul. 13, 1999

[54] POURABLE DETERGENT CONCENTRATES WHICH MAINTAIN OR INCREASE IN VISCOSITY AFTER DILUTION WITH WATER

[75] Inventors: Hoai-Chau Cao, Liege; Patricia Pagnoul, Fooz, both of Belgium

[73] Assignee: Colgate-Palmolive Co., New York, N.Y.

[21] Appl. No.: 08/851,938

[22] Filed: May 6, 1997

Related U.S. Application Data

[63] Continuation-in-part of application No. 08/496,071, Jun. 28, 1995, abandoned, which is a continuation-in-part of application No. 08/380,477, Jan. 30, 1995, abandoned.

[51] Int. Cl.[6] ..... C11D 1/29; C11D 11/00; C11D 17/00

[52] U.S. Cl. ..... 510/340; 510/351; 510/352; 510/356; 510/361; 510/223; 510/229; 510/405; 510/424; 510/427; 510/428; 510/434; 510/495; 510/497; 510/128; 510/159

[58] Field of Search ..... 510/405, 128, 510/223, 159, 229, 340, 351, 352, 356, 361, 424, 427, 428, 434, 495, 497

[56] References Cited

U.S. PATENT DOCUMENTS

| | | | |
|---|---|---|---|
| 3,893,955 | 7/1975 | Hewitt et al. | 510/537 |
| 3,899,448 | 8/1975 | Messenger et al. | 510/537 |
| 5,057,246 | 10/1991 | Bertho et al. | 510/423 |

FOREIGN PATENT DOCUMENTS

| | | |
|---|---|---|
| 0079646 | 5/1983 | European Pat. Off. . |
| 95/02664 | 1/1995 | WIPO . |
| 96/12787 | 5/1996 | WIPO . |
| 96/14376 | 5/1996 | WIPO . |
| 96/21721 | 7/1996 | WIPO . |

*Primary Examiner*—Lorna Douyon
*Attorney, Agent, or Firm*—Bernard Lieberman

[57] ABSTRACT

Aqueous detergent concentrates containing a mixture of two or more surfactants having a differing resistance to electrolytic salting out in the form of micellar solutions and having pourable viscosities are converted into lamellar solutions upon dilution with water where the dispersion contains a viscosity promoting electrolyte present at a narrow range of concentration. Transformation from the micellar phase to the lamellar phase produces an increase in viscosity such that the diluted concentrate has a viscosity equal to or higher than the viscosity of the original concentrate.

8 Claims, 2 Drawing Sheets

POURABLE DETERGENT CONCENTRATES WHICH MAINTAIN OR INCREASE IN VISCOSITY AFTER DILUTION WITH WATER

This application is a continuation-in-part of U.S. Ser. No. 08/496,071 filed Jun. 28, 1995, now abandoned, which in turn is a continuation-in-part of U.S. Ser. No. 08/380,477 filed Jan. 30, 1995, now abandoned, the disclosure of which is incorporated herein by reference.

BACKGROUND OF THE INVENTION

1. Field of the Invention

This invention relates to aqueous detergent concentrates adapted to be diluted by the consumer prior to use.

2. Description of Related Art

There is a trend in the household products and personal care industries to provide products in concentrated form which are adapted to be diluted with water by the consumer prior to use. This approach reduces the bulk of packaging which needs to be disposed of by the consumer and reduces the shipping and handling costs associated with distribution of such products.

Aqueous liquid concentrates such as laundry, fine fabric and dishwasher detergents are normally provided with a high content of active ingredients such that, when diluted by the consumer per packaging instructions, the diluted product will contain an amount of active ingredients normally present in a non-concentrated product.

However, the provision of concentrated liquids gives rise to a number of problems, including viscosity control and stability.

Concentrated liquids tend to exhibit a higher viscosity due to the high content of surfactants, builders, electrolytes and other components present in the concentrate. Concentrates having viscosities in excess of 10,000 cps (mPas) tend to be difficult to pour from the packaging container, while pourable concentrates tend to have insufficient viscosity on the other hand when appropriately diluted by the consumer, thereby reducing consumer appeal. Also, surfactants present at high levels in such concentrates tend to form closely spaced, suspended lamellar structures which tend to contact one another after periods of storage, resulting in a flocculation phenomenon which destabilizes the suspension and leads to a marked increase in product viscosity.

One approach to dealing with poor post-dilution viscosity is to include in the liquid concentrate formulation one or more organic or inorganic thickening agents such as swelling clays, alumina, gums, polymeric materials or cellulosic polymers. However, the use of such thickening additives tends to worsen the problem of concentrate pourability and imparts only a minimal viscosity increase to the diluted concentrate.

Hydrophilic polymeric materials have also been used in liquid detergent concentrates as viscosity control agents. For example, U.S. Pat. No. 4,715,969 discloses that the addition of less than about 0.5% by weight of a polyacrylate polymer, e.g., sodium polyacrylate, having a molecular weight from about 1,000 to 5,000, to aqueous detergent compositions containing primarily anionic surfactants will stabilize the viscosity of the composition and prevent a major increase in viscosity after a period of storage of the formulated composition. Also, EPO 301,883 discloses similar compositions containing from about 0.1 to 20% by weight of a viscosity reducing, water soluble polymer such as polyethylene glycol, dextran or a dextran sulfonate.

While these and other approaches tend to enhance concentrate pourability, they do not solve the problem of poor post-dilution viscosity.

Accordingly, it is an object of the invention to provide a liquid detergent concentrate which exhibits a sufficiently low viscosity such that it is pourable as a free flowing liquid from its packaging container and which also exhibits a viscosity after appropriate dilution with water which is preferably at least equal to the viscosity of the original, undiluted concentrate.

SUMMARY OF THE INVENTION

The present invention provides pourable aqueous detergent concentrate compositions comprising a micellar dispersion of a mixture of at least two surfactants having differing resistance to electrolytic salting out and a dissolved electrolyte salt, which concentrate has a viscosity of less than about 2500 cps (mPas) and which contains the electrolyte salt at a concentration such that, upon dilution of the concentrate with a designated amount of water, the micellar surfactant dispersion is converted at least partially or totally into a lamellar phase dispersion, thereby providing a diluted concentrate having a viscosity in excess of 200 cps, and more preferably a viscosity at least equal to and generally higher than the viscosity of the undiluted concentrate.

The invention also provide a method for preparing a diluted detergent concentrate having a viscosity at least about equal to and generally higher than the viscosity of the undiluted concentrate comprising:

a) providing a detergent concentrate composition comprising an aqueous micellar dispersion of a mixture of at least two surfactants having differing resistance to electrolytic salting out and a dissolved electrolyte salt, which concentrate has a viscosity of less than about 2500 cps (mPas), and b) diluting the concentrate with sufficient water such that said concentrate is at least partially converted into a lamellar phase dispersion, thereby providing a diluted concentrate having a viscosity in excess of 200 cps, more preferably a viscosity at least equal to the viscosity of the undiluted concentrate.

The detergent concentrate composition of the invention is characterized by being free of a nonaqueous solvent and a hydrotrope, such solvent and hydrotrope being exemplified in detergent concentrate compositions of the prior art. The term "nonaqueous solvent " refers to alcohols and ketones. The term "hydrotrope " includes the salts of xylenesulfonate, tolulenesulfonate, cumenesulfonate, urea and similar materials conventionally designated as hydrotropes.

DETAILED DESCRIPTION OF THE INVENTION

When surfactants are solubilized in electrolyte-free water, they exhibit different phase structures in accordance with concentration and degree of water solubility. At concentrations of less than about 30–40 wt %, surfactants usually form the micellar isotropic solution "L" phase. These micelles are aggregates of surfactant molecules, too small to be visible through an optical microscope. These micelles tend to form spherical shapes at lower concentrations and become cylindrical in shape at higher concentrations within this range. Micellar solutions look and behave in most cases as true clear solutions with very low viscosity, e.g., generally less than about 200 cps.

When the surfactant concentration in water is increased up to about 50 to 60 wt %, many surfactants form a wax-like or gel-like "M" phase, also referred to as the liquid crystal phase, in which the cylindrical aggregates are arranged very close together in a hexagonal structure. At this phase, the dispersion is immobile and unpourable due to the fact that mobility of the cylindrical aggregates is limited only along the cylinder lengths.

At concentrations above about 60 wt % and below about 80 wt %, surfactants form a more mobile "G " or "L alpha " lamellar phase. Lamellar phases are anisotropic phases composed of successive bilayers of surfactant arranged in parallel and separated by a liquid medium, usually an aqueous medium. Lamellar phase solutions are less viscous than M phase solutions even though they contain less water. This reduction in viscosity is due to the ease with which the parallel layers can slide over each other during shear. Lamellar phase solutions are, however, generally more viscous than micellar phase solutions.

At still higher concentrations, surfactants form a hydrated solid. Some surfactants such as the non-ionics tend to form a liquid phase containing dispersed water droplets of micelle size.

Further discussion of the properties of various surfactants dispersed in water as a function of concentration is found in U.S. Pat. Nos. 3,893,955, 4,243,549 and 4,753,754.

Figure 1:
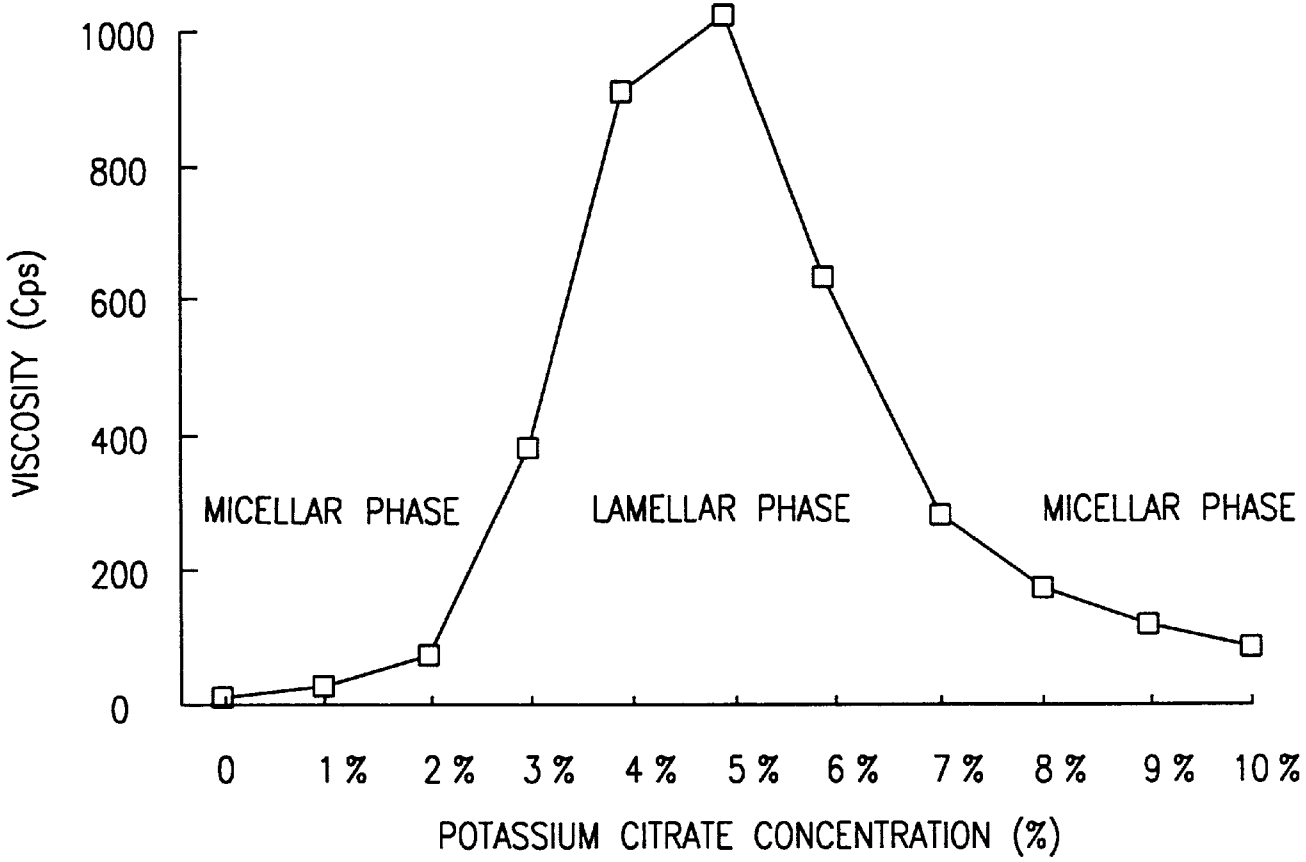
FIG. 1 is a graph plotting viscosity characteristics of a dispersed surfactant system in the micellar and lamellar phases as a function of electrolyte concentration.

The present invention is grounded on the discovery that micellar dispersions of certain combinations of surfactants having differing resistance to electrolytic salting out can be converted at relatively low surfactant concentrations into and out of lamellar phase dispersions as a function of the concentration of water soluble electrolyte added to the dispersion. This phenomenon is illustrated in FIG. 1 which demonstrates the development of a lamellar, more viscous phase within a micellar surfactant dispersion containing a certain concentration range of electrolyte, and reversion to the micellar phase above and below that concentration range.

Thus, concentrated micellar phase detergents containing up to about 60 wt % of surfactants and containing a water soluble electrolyte at a concentration in excess of the concentration which promotes conversion of the micelle phase to the lamellar phase can be diluted with water to the point where the electrolyte concentration falls within the lamellar phase-promoting concentration range for the particular system.

Dilution levels of the concentrate may generally range from about 0.5 to about 5 volumes of water per volume of concentrate. Conversion of the micelle dispersion into a lamellar dispersion produces an increase in viscosity of the detergent composition which at least equals, and normally will exceed, the viscosity of the undiluted, micellar phase concentrate. In effect, lamellar phase development which normally occurs at surfactant concentrations of about 60 to 80 wt % is created in the micellar phase, where the surfactant concentration is considerably lower, by careful control of the concentration of electrolyte present in the dispersion. Thus, viscosity enhancement is achieved without the presence of thickening adjuvants in the concentrate formulation.

The combination of surfactants which may be used in the present invention may be selected from anionic, non-ionic, cationic and amphoteric species, including mixtures containing different species or mixtures of different surfactants within the same species.

Suitable anionic surfactants include the water-soluble alkali metal salts having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil; sodium and potassium alkyl ($C_9$–$C_{20}$) benzene sulfonates, particularly sodium linear secondary alkyl ($C_{10}$–$C_{15}$) benzene sulfonates; sodium alkyl glycerol ether sulfates, especially those ethers of the higher alcohols derived from tallow or coconut oil and synthetic alcohols derived from petroleum; sodium coconut oil fatty monoglyceride sulfates and sulfonates; sodium and potassium salts of sulfuric acid esters of higher ($C_8$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulfonates such as those derived from reacting alpha-olefins ($C_8$–$C_{20}$) with sodium bisulfite and those derived from reacting paraffins with $SO_2$ and $Cl_2$ and then hydrolyzing with a base to produce a random sulfonate; and olefin sulfonates which term is used to describe the material made by reacting olefins, particularly $C_{10}$–$C_{20}$ alpha-olefins, with $SO_3$ and then neutralizing and hydrolyzing the reaction product. The preferred anionic surfactants are ($C_{10}$–$C_{18}$) alkyl polyethoxy (1–11 Eo) sulfates and mixtures thereof having differing water solubilities.

Suitable nonionic surfactants include, in particular, the reaction products of compounds having a hydrophobic group and a reactive hydrogen atom, for example aliphatic alcohols, acids, amides and alkyl phenols with alkylene oxides, especially ethylene oxide, either alone or with propylene oxide. Specific nonionic surfactant compounds are alkyl ($C_6$–$C_{18}$) primary or secondary linear or branched alcohols condensed with ethylene oxide, and products made by condensation of ethylene oxide with the reaction products of propylene oxide and ethylenediamine. Other so-called nonionic surfactant compounds include long chain tertiary amine oxides, long-chain tertiary phosphine oxides, dialkyl sulfoxides, fatty ($C_8$–$C_{18}$) esters of glycerol, sorbitan and the like, alkyl polyglycosides, ethoxylated glycerol esters, ethyoxylated sorbitans and ethoxylated phosphate esters.

The preferred non-ionic surfactant compounds are those of the ethoxylated and mixed ethyoxylated-propyloxylated ($C_6$–$C_{18}$) fatty alcohol type, containing 2–11 EO groups.

Examples of amphoteric surfactants which can be used in the compositions of the present invention are betaines and those which can be broadly described as derivatives of aliphatic secondary and tertiary amines in which the aliphatic radical can be straight chain or branched and wherein one of the aliphatic substituents contains from about 8 to about 18 carbon atoms and one contains an anionic water solubilizing group, e.g., carboxy, sulfonate, sulfate, phosphate, or phosphonate. Examples of compounds falling within this definition are sodium 3-dodecylaminopropionate, sodium 3-dodecylaminopropane sulfonate, N-alkyltaurines, such as prepared by reacting dodecylamine with sodium isothionate, N-higher alkyl aspartic acids and the products sold under the trade name "Miranol".

Examples of betaines useful herein include the high alkyl betaines such as coco dimethyl carboxymethyl betaine, lauryl dimethyl carboxymethyl betaine, lauryl dimethyl alpha-carboxyethyl betaine, cetyl dimethyl carboxymethyl betaine, lauryl bis(2-hydroxyethyl) carboxy methyl betaine, stearyl bis-(2-hydroxypropyl) carboxymethyl betaine, oleyl dimethyl gamma-carboxypropyl betaine, lauryl bis-(2-hydroxypropyl) alpha-carboxyethyl betaine, etc. The sulfobetaines may be represented by coco dimethyl sulfopropyl betaine, stearyl dimethyl sulfopropyl betaine, lauryl bis-(2-hydroxyethyl) sulfopropyl betaine, amino betaine amidosulfobetaines, and the like.

Other suitable betaines include 1-(lauryl, dimethylammonio) acetate-1-(myristyl dimethylammonio) propane-3-sulfonate, 1-(myristyl dimethylamino)-2-hydroxypropane-3-sulfonate, cocoamidoethylbetaine and cocoamidopropylbetaine.

Cationic surfactants which maybe used include mono $C_8$–$C_{24}$ alkyl or alkenyl onium salts, especially mono-or polyammonium salts, imidazolinium salts, pyridinium salts or mixtures thereof. Especially preferred cationics include the following: stearyldimethylbenzyl ammonium chloride; dodecyltrimethylammonium chloride; nonylbenzylethyldimethyl ammonium Nitrate; tetradecylpyridinium bromide; laurylpyridinium chloride; cetylpyridinium chloride; laurylisoquinolium bromide; ditallow(hydrogenated) dimethyl ammonium chloride; dilauryldimethyl ammonium chloride; and stearalkonium chloride.

A more detailed illustration of the various surfactants and classes of surfactants mentioned may be found in the text *Surface Active Agents,* Vol. II, by Schwartz, Perry and Berch (Interscience Publishers, 1958), in a series of annual publications entitled *McCutcheon's Detergents and Emulsifiers,* issued in 1969, or in *Tenside-Taschenbuch,* H. Stache, 2nd Ed. Carl Hanser Verlag, Munich and Vienna, 1981.

In order to achieve the objectives of this invention, the surfactant or at least one of a combination of two or more surfactants used must possess a high resistance to salting out in the presence of an electrolyte such as potassium citrate or sodium chloride. By "high salting out resistance " is meant that a 10% by weight aqueous solution of a particular surfactant should remain as a clear isotropic, stable solution where the aqueous solution contains about 4% by weight of dissolved citrate electrolyte.

Conversely, a surfactant of low electrolyte resistance is one where a 10% by weight aqueous solution would form a cloudy, turbid or two phase solution in the presence of 4% by weight or less of potassium citrate.

Thus, high salting out resistant surfactants which can be used alone or as a mixture in the composition of this invention include $C_{12}$–$C_{14}$ fatty alcohol ether sulfates (AEOS) with 2 or 3 moles of ethylene oxide, preferably 2 moles of ethylene oxide and mixtures thereof. Some other high salting out resistant surfactants, e.g. betaines and AEOS surfactants having 4 or greater EO groups cannot be used as the sole surfactant because they do not provide the desired viscosity boost at relatively low electrolytic levels.

Low salting out resistant surfactants which cannot be used as the sole surfactant include linear alkyl benzene sulfonates (LAS) or the alkyl sulfates, since these tend to salt out in the presence of only 1% by weight electrolyte. Other surfactants which can not be used alone include AEOS surfactants having a high EO content, e.g. 4 moles or greater and betaines, because, although they have a high resistance to electrolytic salting out, they do not exhibit a substantial viscosity boost when diluted with water.

In a more preferred embodiment of the invention, the surfactants comprise a mixture of two or more surfactants, at least one of which has a high salting out resistance and at least one other of which has a low salting out resistance. Such a combination provides the desired balance of electrolytic stability afforded by the electrolyte-resistant surfactant combined with a higher boost in viscosity provided by the non-electrolyte resistant surfactant when the surfactant phase is converted from the micellar phase to the lamellar phase upon dilution with water.

Specific combinations of surfactants which may be used include AEOS (2 EO) or AEOS (3 EO) mixed with AEOS>(4 EO); AEOS (2 EO) blended with AEOS (3 EO) (4:1 to 1:4 blend ratios); a mixture of a betaine, e.g. cocoamidopropylbetaine, with linear alkyl benzene sulfonate (3:1 to 1:1 blend ratios); a blend of $C_8$ to $C_{18}$ alkyl sulfates or sulfonates with AEOS (2 or 3 EO) at 2:1 to 1:2 blend ratios; a ternary blend of $C_8$ to $C_{18}$ alkyl sulfate or sulfonate with a $C_{13}$–$C_{15}$ fatty ethoxy alcohol (6–10 EO) and AEOS (2–3 EO), blended at about equal parts of each surfactant; a ternary blend of a betaine, e.g. cocoamidoproplybetaine, with a $C_{13}$–$C_{15}$ fatty ethoxy alcohol (6–10 EO) and AEOS (2–3 EO) and like combinations.

When combined, such surfactants exhibit the desired balance of properties and stability required for the present invention. Accordingly, some trial and error may be required to determine the optimum surfactant combination. Surfactants may be combined in the relative weight ratios of about 4:1 to 1:4 respectively. A particularly preferred surfactant combination comprises a mixture of an anionic alkyl polyethoxy sulfate (AEOS) wherein the alkyl group contains from about 10 to 18 carbon atoms and the polyethyoxy is of 2 to 7 ethylene oxide groups, more preferably 2 or 3 ethylene oxide groups and a non-ionic ethoxylated fatty alcohol wherein the fatty alcohol contains from about 6 to 18 carbon atoms and containing 2–11 ethylene oxide groups, used in the relative proportion of 3:1 to 1:3.

The surfactant combination may be present in the concentrate at a level of from about 10 to 60% by weight, more preferably from about 10 to 35% by weight.

Electrolytes which may be used in the present invention include one of a mixture of water soluble organic and inorganic salts. Suitable inorganics include alkali or alkaline earth metal chlorides, sulfates, phosphates, acetates and nitrates such as sodium, magnesium, lithium or calcium chloride, potassium bromide, calcium sulfate and the like. Organic salts include the citrates, formates and salts of ethylene diamine tetraacetic acid. A preferred electrolyte is sodium or potassium citrate since it also contributes as a builder in detergent compositions in the amount used.

The amount of electrolyte present in any given concentrate is determined by first evaluating the concentration in a diluted product containing a given combination of surfactants where conversion from the micellar into the lamellar phase is achieved, and than multiplying that level of concentration by the dilution factor as hereinafter described. Generally speaking, the concentrate will normally contain electrolyte at a level in the range of from about 1 to about 30% by weight.

The detergent composition of the invention may be used in numerous applications such as heavy duty laundry detergents, dish detergents, household cleaners, shampoos, body douche and body lotions. Accordingly they may contain the usual quantities of one or more adjuvants such as phosphorous and non-phosphorous containing builders, fluorescent brighteners, dyes, perfumes, viscosity regulators, shampoo adjuvants, enzymes, bleaches, batericidies, fungicides, anti-foam agents, preservatives, stabilizers and skin conditioners. The adjuvants should not, however, be of a type which will promote instability of the product on standing.

For the purposes of this invention, all references to viscosity are viscosity measured at a product temperature of 25° C. using a Brookfield RVT.DV11 viscometer at 10 rpm, with a #1 spindle from 0 to 1000 mPas (cps) and a #2 spindle from 1000 to 4000 mPas (cps).

The following examples are illustrative of the invention.

Example 1

A stock fine fabric detergent formulation was prepared by mixing the following ingredients (as 100% active ingredients by weight) and in the following proportions in a high shear mixer:

| | |
|---|---|
| Deionized water | 89.43% |
| NI-7EO* | 3.70 |
| AEOS-3EO** | 3.80 |
| Coco amino betaine | 1.50 |
| Foam control - myristic acid | 0.10 |
| Foam control - lauric acid | 0.70 |
| Fragrance | 0.35 |
| Protein cosmetic | 0.01 |
| Opacifier | 0.38 |
| Preservative | 0.03 |
| Dye | 0.0001 |

*NI-7EO is $C_{13}$–$C_{15}$ fatty alcohol with 7EO.
**AEOS-3EO is $C_{12}$–$C_{14}$ fatty alcohol ether sulfate with 3EO.

The resulting product was a clear micellar dispersion having a viscosity of about 12 cps (12 mPas). Ph was adjusted to about 7.4 to 7.6 by addition of potassium hydroxide (50%). The product had a total active ingredient content of about 10.5%, of which about 9% is surfactant content.

Example 2

A series of ten additional solutions (A–J) having the composition of Example 1 were prepared except that a combination of citric acid and potassium hydroxide (50%) at about a 1.0 to 0.9 weight ratio was added at appropriate weight levels to form solutions containing about 1, 2, 3, 4, 5, 6, 7, 8, 9 and 10% by weight, respectively, of potassium citrate electrolyte. Ph of each was adjusted to 7.4–7.6 as above. Viscosity measurements were as follows:

| EXAMPLE | ELECTROLYTE CONCENTRATION (WT %) | VISCOSITY (CPS) |
|---|---|---|
| 1 | 0 | 12 |
| 2A | 1 | 20 |
| 2B | 2 | 75 |
| 2C | 3 | 390 |
| 2D | 4 | 910 |
| 2E | 5 | 1020 |
| 2F | 6 | 625 |
| 2G | 7 | 290 |
| 2H | 8 | 175 |
| 2I | 9 | 120 |
| 2J | 10 | 100 |

Microscopic examination of the samples showed the development of a lamellar phase at electrolyte concentrations in the range of from about 3–7% by weight, with peak lamellar phase development at about 4–5% by weight electrolyte concentration. Above and below these electrolyte concentrations, the solutions were essentially clear, isotropic, micellar solutions. These data are plotted in FIG. 1.

These data suggest that concentrated versions of the formulations described above may be prepared by simply increasing the concentration of the active ingredients, including electrolyte, up to but below the point where stable, pourable micellar phase dispersions having a viscosity of 200 cps or less can no longer be formed. Upon dilution of these micellar concentrates with an appropriate amount of water to the point where the electrolyte concentration best promotes viscosity enhancement, in this case about 4 to 5% by weight concentration, a diluted product having a viscosity at least equal to or higher than the original viscosity of the concentrate will be obtained. This is illustrated by the following Example.

Example 3

A concentrate having approximately double the concentration of active ingredients of Example 2E, which contained about 5% by weight electrolyte, was prepared as described above. The concentrate had the following composition:

| | |
|---|---|
| Deionized water | 67.9% |
| NI-7E0 | 7.40 |
| AEOS-3EO | 9.00 |
| Coco amino betaine | 3.00 |
| Foam control - myristic acid | 0.10 |
| Foam control - lauric acid | 1.50 |
| Citric acid (anhy) | 5.00 |
| KOH (50%) | 4.40 |
| Fragrance | 0.70 |
| Protein cosmetic | 0.01 |
| Opacifier | 0.75 |
| Preservative | 0.07 |
| Dye | 0.0002 |

The pH of the concentrate was adjusted to 7.4 to 7.6 using 50% KOH as above. The concentrate had a viscosity of 100–150 cps and formed a clear, isotropic micellar dispersion. Total active ingredients were about 31.2% by weight, of which about 19.4% by weight is surfactant and about 9% by weight is potassium citrate electrolyte.

Figure 2:
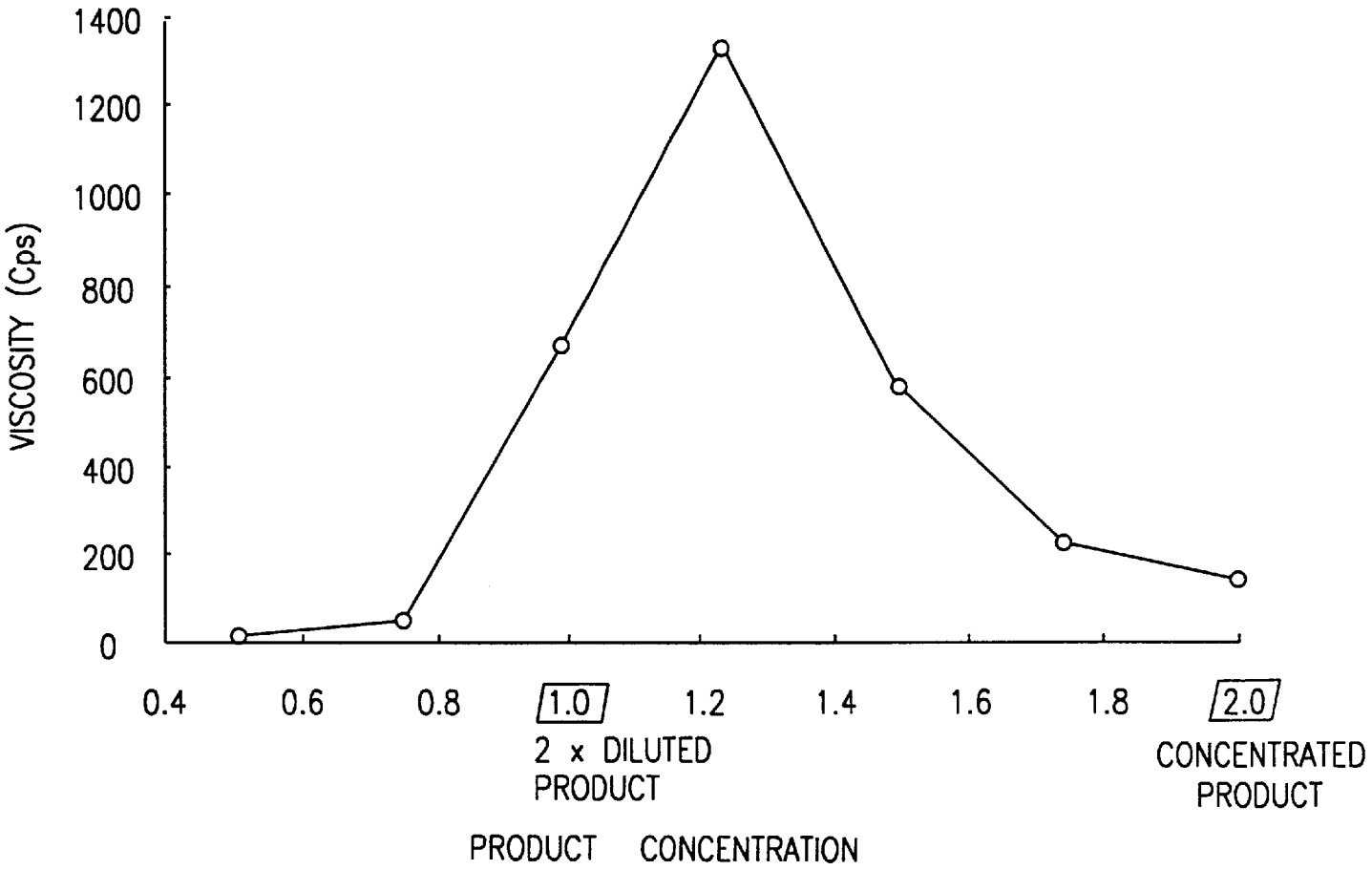
FIG. 2 is a graph plotting viscosity enhancement of a detergent concentrate of the invention as a function of the degree of dilution with water.

Portions of the concentrate were then diluted with varying amounts of tap water as illustrated in FIG. 2. The concentrate developed a marked increase in viscosity with increasing dilution up to a maximum value in the lamellar phase and then began to drop again with the reformation of a micellar solution. The twice diluted product (one volume water per volume of concentrate) exhibited a viscosity in the range of 600–800 cps.

Accordingly, pourable detergent concentrates having a viscosity of 200 cps and less are readily converted, by simple mixing, into water diluted concentrates having a viscosity in excess of 400 cps which have considerable appeal to the consumer.

What is claimed is:

1. An aqueous laundry detergent concentrate composition consisting of (i) a micellar dispersion of a mixture of at least two surfactants having differing resistance to electrolytic salting out such that at least one of said surfactants is resistant to salting out and at least one other of said surfactants is not resistant to salting out, said mixture consisting of at least one anionic surfactant which is an alkyl polyethoxy sulfate wherein the alkyl group ranges from 10 to 18 carbon atoms and the polyethoxy is of 2 to 11 ethylene oxide groups, and at least one nonionic surfactant which is an ethoxylated fatty alcohol wherein the fatty alcohol ranges from 6 to 18 carbon atoms and the ethoxylated fatty alcohol having 2 to 11 ethylene oxide groups, and (ii) a dissolved electrolyte salt which is an alkali metal citrate, said concentrate has a viscosity in the range of about 100 to 200 cps and said electrolyte salt is present in said concentrate at a level such that, upon dilution of said concentrate with an amount of water of from about 0.5 to about 5 volumes of water per volume of concentrate, said micellar surfactant dispersion is converted at least partially into a lamellar phase dispersion providing a diluted concentrate having a viscosity in excess of 400 cps.

2. The composition of claim 1 wherein said surfactants are present at a level of from about 10 to about 60% by weight.

3. The composition of claim 1 wherein said electrolyte salt is present at a level of from about 1 to about 30% by weight.

4. An aqueous detergent concentrate composition consisting of a micellar dispersion of surfactant consisting of $C_{10}$ to $C_{18}$ alkyl diethoxy sulfate and $C_{10}$ to $C_{18}$ alkyl triethoxy sulfate, and a dissolved electrolyte salt, said concentrate having a viscosity in the range of about 100 to 200 cps and said electrolyte salt is present in said concentrate at a level such that, upon dilution of said concentrate with an amount of water of from about 0.5 to about 5 volumes of water per volume of concentrate, said micellar surfactant dispersion is converted at least partially into a lamellar phase dispersion providing a diluted concentrate having a viscosity in excess of 200 cps.

5. A method for preparing a diluted laundry detergent concentrate having a viscosity at least equal to the viscosity of the undiluted concentrate consisting of:

(a) providing a detergent concentrate consisting of (i) an aqueous micellar dispersion of a mixture of at least two surfactants having differing resistance to electrolytic salting out such that at least one of said surfactants is resistant to salting out and at least one other of said surfactants is not resistant to salting out, said mixture consisting of at least one anionic surfactant which is an alkyl polyethoxy sulfate wherein the alkyl group ranges from 10 to 18 carbon atoms and the polyethoxy is of 2 to 11 ethylene oxide groups, and at least one nonionic surfactant which is an ethoxylated fatty alcohol wherein the fatty alcohol ranges from 6 to 18 carbon atoms and the ethoxylated fatty alcohol having 2 to 11 ethylene oxide groups, and (ii) a dissolved electrolyte salt which is an alkali metal citrate, said concentrate has a viscosity in the range of about 100 to 200 cps; and (b) diluting said concentrate with sufficient water such that said concentrate is at least partially converted into a lamellar phase dispersion providing a diluted concentrate having a viscosity in excess of 400 cps.

6. The method of claim 5 wherein said concentrate is diluted with from about 0.5 to about 5 volumes of water per volume of concentrate.

7. The method of claim 5 wherein said surfactants are present at a level of from about 10 to about 60% by weight.

8. The method of claim 5 wherein said electrolyte salt is present at a level of from about 1 to about 30% by weight.

* * * * *